US006099298A

United States Patent [19]

Potskhishvili et al.

[11] Patent Number: 6,099,298

[45] Date of Patent: Aug. 8, 2000

[54] GAS LIGHTER WITH SAFETY DEVICE

[76] Inventors: David Vakhtangovich Potskhishvili, B. Gruzinskaya d. 40, str. 1, kv. 19, Moskva, Russian Federation, 123056; Karlo Vakhtangovich Potskhishvili, Gldanskiy massiv II m.r.k. 28, kv. 73, Tbilisi, Georgia, 380038

[21] Appl. No.: 09/453,060

[22] Filed: Dec. 2, 1999

[51] Int. Cl.[7] ..... F23D 11/36

[52] U.S. Cl. ..... 431/153; 431/276; 431/277

[58] Field of Search ..... 431/153, 273, 431/276, 277

*Primary Examiner*—Carroll Dority

*Attorney, Agent, or Firm*—Jacobson, Price, Holman & Stern, PLLC

[57] ABSTRACT

This invention relates to the field of energy and is directed to a gas child-proof lighter, i.e. the lighter in which means for sparking neutralization are combined with a gas ignition mechanism. The gas lighter comprises a gas ignition device including a corrugated wheel secured on a shaft rotatably and movably mounted in profiled openings of body brackets, as well as a flint spring pressed toward the corrugated wheel. The cylindrical shaft of the corrugated wheel is mounted in said opening so as to move along a direction which is transverse relative to a direction of action of the flint spring, and in a direction coinciding with the direction of action of the flint spring. The opening is a convex polygon with a right angle between adjacent walls. The ends of the wall of corrugated wheel are provided with spigots having a polygonal surface. In a first position of the shaft in the slot, its rotation axis extends through a line coinciding with the direction of action of the flint spring, while in a second position of the shaft in said slot from the side opposite the burner valve location, the rotation axis of the shaft of the corrugated wheel is biased with respect to said line, whereby the shaft spigot is positioned in the slot engaging the slot wall and preventing the lighter form the possibility of igniting the gas.

2 Claims, 3 Drawing Sheets

GAS LIGHTER WITH SAFETY DEVICE

BACKGROUND OF THE INVENTION

The present invention relates to the field of energy and is directed to a child-proof lighter, i.e. the lighter provided with a means for neutralizing ignition elements being movable between an operating neutralizing position wherein no spark is struck on activating an ignition device, and a position wherein it is possible to produce a spark required to ignite the gas.

Lighters of this type are known which are described in GB, No.A-2304879, U.S. Pat. Nos. 5,096,414, 5,547,370, 5,868,561 in which a gas ignition device includes a corrugated wheel positioned on a shaft and firmly connected with it, gearwheels rotatably positioned on said shaft by the sides of the corrugated wheel, a flint spring pressed toward the corrugated wheel, whereby said shaft has side portions on which these gearwheels are located and formed as a polyhedron, and end portions which are cylindrical and disposed in openings of brackets of the lighter body. A maximum diameter of the shaft in the area where the gearwheels are mounted is less than a minimum diameter of the openings of these wheels.

When the corrugated wheels are classically acted upon, the latter turn about the shaft which precludes striking a spark since the corrugated wheel will not rotate. To ignite the gas exiting the lighter burner valve, it is necessary to depress the gearwheels, to force them into contact with the shaft edges and to turn the wheels in conventional manner. Due to friction appearing when the gearwheels and the shaft interact in the contact area, the shaft and the corrugated wheel sitting on it can turn.

Safety devices described in the patents do not require any additional buttons and lever movements in order to achieve the goal which makes them more attractive as compared to other lighters. The only thing required from a user is to more attentively and with a certain force to depress the gearwheels, otherwise they would rotate idly.

However, due to the fact that the gearwheels rotate about the shaft independently of one another, the user not always is able to select the force needed to turn the corrugated wheel. In certain cases, the both gearwheels operate in time but sometimes, only one. Therefore, the user now easily lights the lighter, now with some difficulty.

With all classical lighters, the spark striking device is of an integral design. The above-mentioned inventions lack this feature. Here the spark striking wheel consists of a plurality of loosely interconnected parts. This complicates the process of assembling and repairing the lighter, and in the event the lighter drops, there is a risk to lose some parts.

A gas lighter is known from EP, No. 0752559 having a safety device designed to prevent the possibility of children igniting the lighter, which lighter comprises a gas ignition device including a corrugated wheel secured to a shaft rotatably and movably mounted in profiled openings of body brackets, a flint spring pressed toward the corrugated wheel. In these lighters, the shaft of the corrugated wheels is mounted in the profiled openings of the body brackets and is movable along a direction which is perpendicular to a direction of action of the flint spring. The profiled opening is a shaped slot in which, in a first position at one slot wall a rotation axis of the shaft of the corrugated wheel extends through a line coinciding with the direction of action of the flint spring, while in a second position at a slot wall from the side opposite the burner valve location, the rotation axis of the shaft of the corrugated wheel is biased relative to said line. Whereby, in the second position at the other slot wall from the side opposite to the burner valve location, the corrugated wheel is spring pressed from the side of the flint in a direction tangential to the outer surface of the corrugated wheel.

Operational reliability and durability of such a lighter are determined by the state of the shaped slot. Unless the shape of this slot is not changed the lighter implements its function of preventing children from using it. When the slot shape is changed, fixation of the shaft of the corrugated wheel in extreme positions of the slot is broken. In the known lighter, the shaft of the corrugated wheel is triangular in cross-section, while the body brackets are made from a polymer the hardness of which is substantially less than that of steel of which the shaft of the corrugated wheel is made. When the shaft with triangular cross-section moves along the walls of shaped slot, the shaft edges forcefully act on the slot walls and deform them, which results in changing the shape of the slot itself, due to which the shaft of the corrugated wheel within the slot may occupy not only two fixed positions corresponding to the lighter operating position and neutralization mode, but also intermediate positions from which this shaft can easily jump to a neutralization removal position.

Based on the foregoing, it is possible to formulate a number of requirements compliance with which would allow to enhance the operational indicators of the gas lighter with safety device, the main of which is increased reliability of the safety device.

BRIEF DESCRIPTION OF THE INVENTION

The object of the present invention is to provide a gas lighter with reliable protection and a more reliable and durable safety device the operational capabilities of which would not depend on the service life of the lighter and would enable to increase the safety level.

According to the invention, the desired result is achieved due to the fact that the lighter comprises a gas ignition device including a corrugated wheel secured to a shaft rotatably and movably mounted in profiled openings of body brackets, gearwheels disposed by the sides of the corrugated wheel and firmly coupled to the shaft of the latter, a flint spring pressed toward the corrugated wheel. Here the shaft of the corrugated wheel is mounted in the profiled openings of the body brackets to move along a direction coinciding with a direction of action of the flint spring and along a direction which is perpendicular to the direction of action of the flint spring, the shaft of the corrugated wheel is cylindrical, while its outlet ends by the sides of the gearwheel are fixedly provided with spigots having an outer surface in the form of a polygon, e.g. in the form of triangle.

The profiled opening is a polygonal slot in the form of a non-convex polygon with rectilinear walls each adjacent of which are disposed at a right angle, wherein a vertical slot wall from the side of a burner valve is higher than a vertical wall located opposite in the slot, and the brackets in the area of the profiled opening from the side of the spigots are provided with recesses having a depth which is less than the bracket thickness and a width which is not less than a maximum outer diameter of the spigot.

In a first position at one vertically directed slot wall, a rotation axis of the shaft of the corrugated wheel extends through a line coinciding with the direction of action of the flint spring, while in a second position at another vertically directed slot wall, from the side opposite the burner valve location, the rotation axis of the shaft of the corrugated wheel is biased relative to said line. In the second position, at the other slot wall from the side opposite to the burner valve location, the corrugated wheel is spring pressed from the side of the flint in a direction tangential to the outer surface of the corrugated wheel.

DETAILED DESCRIPTION OF THE DRAWINGS

The present invention is illustrated with the following drawings which represent the preferred embodiment according to each variation but are not single but demonstrate the possibility of achieving the desired result by totality of essential features set forth in the claims.

DETAILED DESCRIPTION OF THE INVENTION

Figure 1:
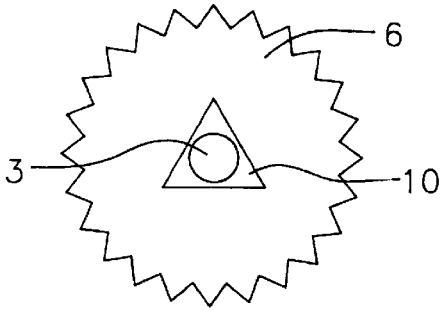
FIG. 1 is a side view of the gearwheel.

By a gas lighter within the scope of the present invention is meant a classical lighter having, generally, an extended elongate body 1 (FIGS. 1, 3, 5, 6) being a receptacle for liquefied gas and which is provided, in its upper part and integral with the body, with two brackets 2 having openings in which the shaft 3 of the corrugated wheel 4 is pivotally mounted. From one end of the brackets, in the body the burner valve is secured coupled with a control lever pivotally fixed in the bracket 2 below the shaft 3. The shaft 3 has also the gearwheels 6 secured to it and located by the sides of the corrugated wheel and designed to transmit rotation from a user's finger to the corrugated wheel. Under the corrugated wheel, in the body a channel is formed for receiving a spring 7 which presses the flint 8 against the corrugated surface of wheel 4. Generally, in most known designs of such type of lighters, the channel for the spring and flint is formed along the body. Therefore, by the direction of action of the flint spring is meant a direction from a body end portion (in which a valve for filling-up the receptacle with liquefied gas is mounted) to its head in which the gas ignition device is housed. Design of such lighter is schematically presented in FIG. 1.

In order to unambiguously understand the spatial arrangement of lighter parts and assemblies relative to each other, it is assumed that the gas lighter is in a vertical position with the body end portion (from the side of the valve for filling-up with gas) bearing against a support surface. The lighter head with the gas ignition device is located in the upper portion of the body. With such position of the lighter, indications of vertical and horizontal directions correspond, respectively, to a direction along the body and a direction across the body.

According to the present invention, the gas lighter with safety device designed to prevent the possibility of children igniting the lighter comprises the gas ignition device with the corrugated wheel 4 secured on the cylindrical or tubular shaft 3 which is rotatably and movably mounted in the profiled openings 9 (FIG. 3) of the brackets 2 of the body 1.

Figure 3:
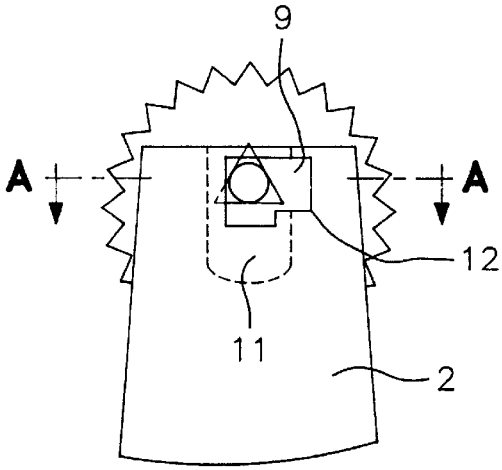
FIG. 3 is a view of the bracket of the lighter body from the side of the profiled opening.

Shaft 3 of the corrugated wheel 4 is mounted in the profiled openings 9 of the body brackets to move along a direction which is perpendicular to the direction of action of the spring 7 of flint 8, and in a direction which coincides with the direction of action of flint spring. The profiled opening is a slot in the form of a non-concave polygon with rectilinear walls, as shown in FIG. 3. Here each adjacent walls are positioned at a right angle with respect to one another, while the vertical slot wall from the side of the burner valve is higher than the vertical wall located opposite in this slot. Whereby, by the term "vertical wall" such disposition of the wall is meant in which the wall surface is disposed along the body.

Figure 2:
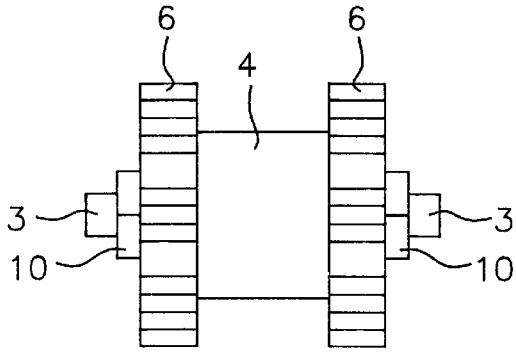
FIG. 2 is a general view of assembled corrugated wheel assembly.

Outlet ends of the shaft 3 of the corrugated wheel 4, by the sides of the gearwheels, are securely provided with spigots 10 (FIGS. 1, 2) having their outer surface in the form of a polygon, e.g. in the form of triangle.

Figure 4:
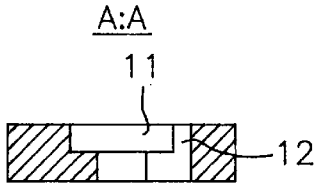
FIG. 4 is a section A—A of FIG. 3.

The brackets 2, in the area of the profiled opening from the side of the spigots 10, are provided with recesses 11 (FIGS. 3, 4) with a depth that is less than the bracket thickness and with a width which is not less than a maximum outer diametrical dimension of the spigot. Each recess 11 is formed such that a part of slot walls do not get into the recess which causes a protrusion 12 to be formed having a width equal to the width of the bracket intended to interact with an edge of the outer surface of the spigot. Each recess in the bracket is biased relative to the profiled opening in the direction of the burner valve to form in this opening a part of its wall in the form of the protrusion 12 with the width equal to the width of the bracket, for interaction with the edge of the outer surface of the spigot.

Figure 5:
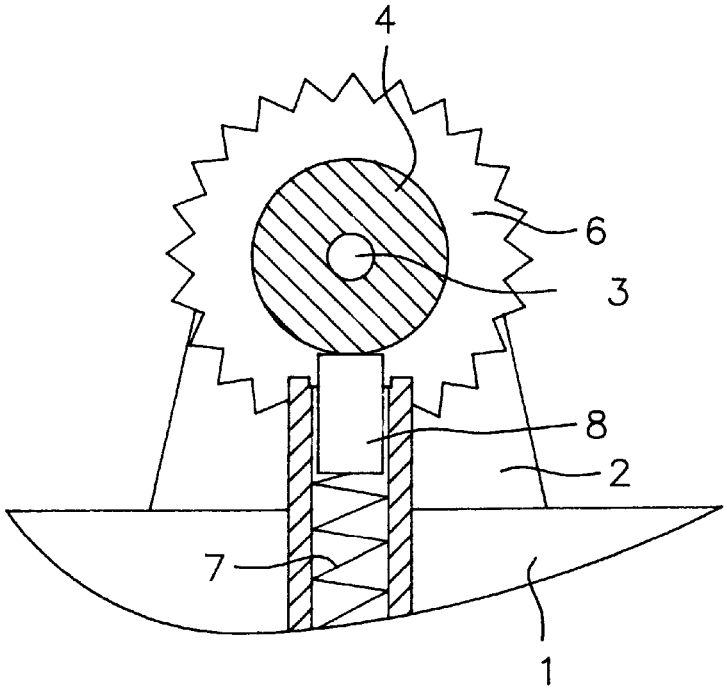
FIG. 5 is a general view of the ignition device with the corrugated wheel being in the sparking mode.
Figure 6:
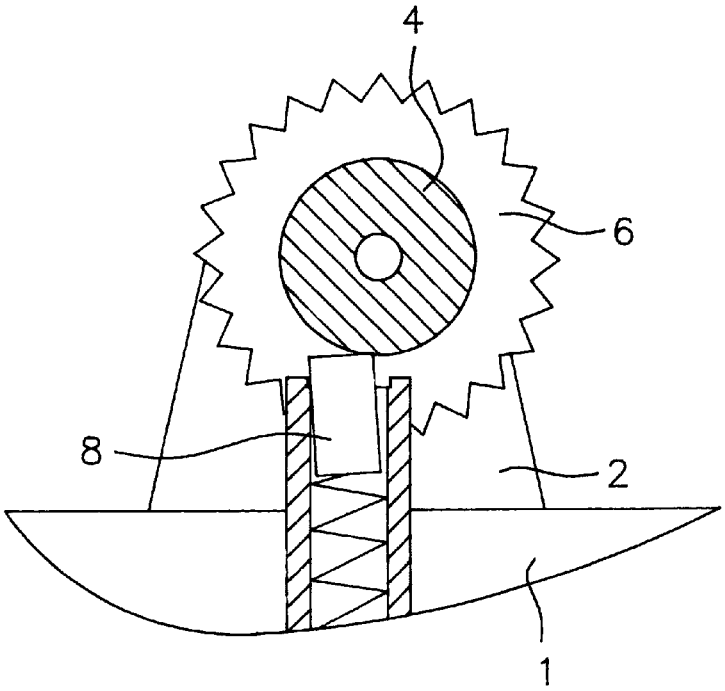
FIG. 6 is a general view of the gas ignition device of FIG. 5 with the corrugated wheel being in the sparking neutralization mode.

In a first position I at the vertically directed wall from the side of the slot of the burner valve, the rotation axis of the shaft 3 of the corrugated wheel 4 extends through a line coinciding with the direction of action of the flint spring, as shown in FIG. 5, whilst in a second position II at the other vertically directed slot wall from the side opposite to the burner valve location, the rotation axis of shaft 3 of the corrugated wheel is biased relative to said line, as shown in FIG. 6. Whereby in the second position at the other slot wall from the side opposite the burner valve location, the corrugated wheel 4 is spring pressed from the side of the flint in the direction tangential to the outer surface of the corrugated wheel (FIG. 6). If the first position I corresponds to the neutral position of the corrugated wheel relative to the flint wherein shaft 3 is likely to move both to the position III of spark striking and to the position II wherein rotation of the corrugated wheel is blocked, then in the second position II, the corrugated wheel interacts with the flint on the edge of the latter. The flit edge functions as a tooth or wedge preventing the the corrugated wheel from rotating. In this case, it is impossible to tern the corrugated wheel. When the user applies excessive force, the lighter breaks down.

The gas lighter according to the invention is operated as follows.

In the position II (FIG. 8) being the position of sparking neutralization, the shaft 3 with the spigot 10 is in the slot in an extreme position from the side opposite the burner valve location. Here one of the edges of the outer surface of spigot 10 bears against the surface of the protrusion 12 which is a part of the horizontally disposed slot wall. As seen in FIG. 6, in this position the corrugated wheel 4 is pressed by its spring 7 of flint 8 which securely retains the corrugated wheel in the biased position relative to the flint eliminating sparking. Trying to ignite the lighter, the user (child) rotationally presses with a finger on the gearwheels. However, the corrugated wheel will not turn since it is blocked by the flint edge. This effect is enhanced because the spigots 10 are rigidly coupled to the shaft 3.

To remove the neutralization mode, the user moves with his finger the gearwheels (together with the corrugated wheel) from the position II into the position I (FIG. 3), wherein the corrugated wheel is positioned over the flint at the slot vertical wall from the side of the burner valve. In the horizontal movement of the shaft, the spigots jump off the protrusion of the slot horizontal wall and are completely received by the recesses 11. This position is considered neutral. In this position, the corrugated wheel can rotate.

In order to provide sparking, the user moves the gearwheels from position I into position III in the direction of the flint, depresses the gearwheels and presses the corrugated wheel against the latter. In this position, when the corrugated wheel rotates, the sparking occurs. When the force applied to the gearwheels is removed, the shaft 3 returns into position I.

The present invention makes it possible to increase the lighter reliability with respect of safety of operation thereof.

We claim:

1. A gas lighter with safety device designed to prevent the possibility of children igniting the lighter, comprising:

a gas ignition device including a corrugated wheel secured to a shaft rotatably and movably mounted in profiled openings of body brackets, gearwheels located by the sides of said corrugated wheel and rigidly coupled to the shaft of the latter, a flint spring pressed toward the corrugated wheel, said shaft of the corrugated wheel being mounted in said profiled openings of the body brackets to move along a direction coinciding with a direction of action of said flint spring and along a direction which is perpendicular to the direction of action of said flint spring, said shaft of the corrugated wheel being cylindrical while its outlet ends by the sides of said gearwheels are securely provided with spigots having an outer surface in the form of a polygon, said profiled opening being a polygonal slot in the form of non-convex polygon with rectilinear walls, wherein each adjacent walls are disposed at a right angle, whereby the slot vertical wall from the side of a burner valve is higher than the opposite vertical wall positioned in this slot, said brackets in the area of said profiled opening from the side of the spigots are provided with recesses having a depth which is less than the bracket thickness and a width which is not less than a maximum outer diameter of the spigot, each recess in said bracket being biased relative to said profiled opening in a direction of the burner valve to form in said opening a part of its wall in the form of a protrusion having a width which is equal to the width of said bracket, to interact with an edge of the spigot outer surface, in a first position at one vertically directed slot wall, a rotation axis of said shaft of the corrugated wheel extending through a line which coincides with the direction of action of the flint spring, whilst in a second position at another vertically directed slot wall from the side opposite to the burner valve location, the rotation axis of said shaft of the corrugated wheel being biased relative said line, wherein in the second position at the other slot wall from the side opposite to the burner valve location, said corrugated wheel is spring pressed from the side of the flint in a direction tangential to the outer surface of said corrugated wheel.

2. A gas lighter with safety device according to claim 1, characterized in that said outer surface of said spigot of the shaft of the corrugated wheel is in the form of triangle.

* * * * *

UNITED STATES PATENT AND TRADEMARK OFFICE

CERTIFICATE OF CORRECTION

PATENT NO. : 6,099,298

DATED : August 8, 2000

INVENTOR(S) : Potskhishvili, et al.

Figure 7:
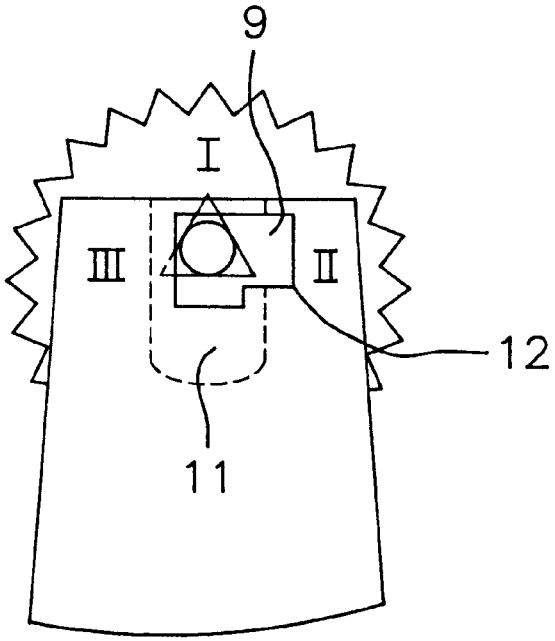
FIG. 7 is the same as in FIG. 3, position of elements in the sparking mode.
Figure 8:
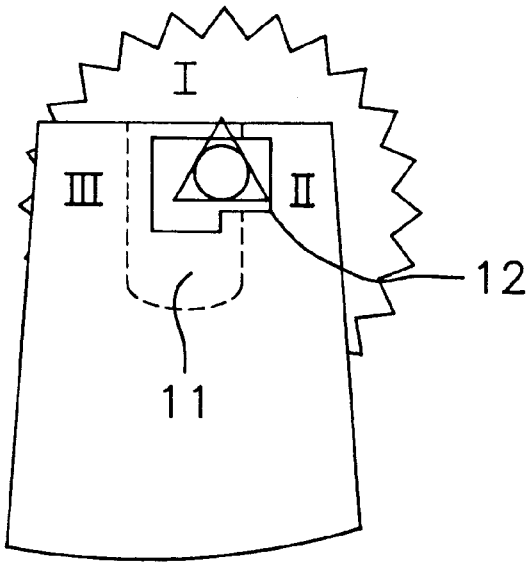
FIG. 8 is the same as in FIG. 3, position of elements in the sparking neutralization mode.

It is certified that error appears in the above-identified patent and that said Letters Patent is hereby corrected as shown below:

Drawing figures 7 and 8 should be deleted to appear as per attached sheet.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO : 6,099,298

DATED : August 8, 2000

INVENTOR(S) : POTSKHISHVILI, et al.

It is certified that error appears in the above-identified patent and that said Letters Patent is hereby corrected as shown below:

FIG. 7

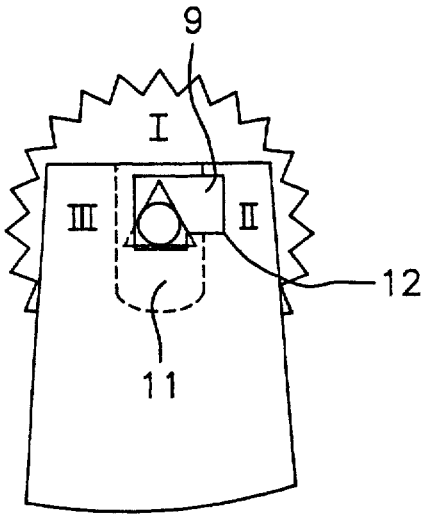

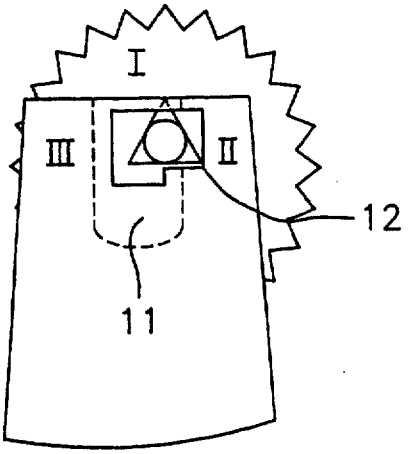

FIG. 8